United States Patent [19]

Yoshimura

[11] 4,036,044

[45] July 19, 1977

[54] PROCESS FOR FORMING METAL PIPES TO A DESIRED SHAPE

[75] Inventor: Tomio Yoshimura, Osaka, Japan

[73] Assignee: Zenzo Matsunaga, Tokyo, Japan

[21] Appl. No.: 671,940

[22] Filed: Mar. 30, 1976

[30] Foreign Application Priority Data

Apr. 7, 1975 Japan ..... 50-41990

[51] Int. Cl.[2] ..... B21B 19/12

[52] U.S. Cl. ..... 72/85; 72/81; 72/83

[58] Field of Search ..... 72/81, 83, 78, 82, 84, 72/85, 96, 100, 121, 122; 273/72 A; 29/DIG. 41

[56] References Cited

U.S. PATENT DOCUMENTS

| | | | |
|---|---|---|---|
| 1,499,128 | 6/1924 | Shroyer | 273/72 A |
| 1,684,206 | 9/1928 | Smith | 72/83 |
| 2,330,811 | 10/1943 | Darner et al. | 72/81 |
| 3,109,400 | 11/1963 | Paulton | 72/83 |
| 3,477,264 | 11/1969 | Sohlemann | 72/81 |
| 3,810,375 | 5/1974 | Oehm | 72/81 |

*Primary Examiner*—Lowell A. Larson
*Attorney, Agent, or Firm*—Larson, Taylor and Hinds

[57] ABSTRACT

A process for forming metal pipes to a desired shape comprising fitting a metal pipe onto a model having same profile as the one desired to form, fixing the pipe thereon, arranging a plurality of metal rollers at same distance and around the metal pipe in such a manner that these rollers are in contact with the pipe always keeping their centers on the circumference of a concentric circle irrespective of the change in their position during their forward and backward movement relative to the longitudinal center axis of the model and rotating the metal pipe integral with the model in the longitudinal direction while forcing the rollers to move forwards and backwards.

1 Claim, 9 Drawing Figures

PROCESS FOR FORMING METAL PIPES TO A DESIRED SHAPE

The present invention relates to a process for forming metal pipes to a desired shape and, more particularly, a process capable of forming metal pipes to have any wall thicknesses or any profiles desired without deteriorating the property and the strength of the metal pipes.

BACKGROUND OF THE INVENTION

It has been common to employ the swaging process in the case of forming metal pipes to a desired shape. For example, the baseball bat made of metal has been also gained by forming a metal pipe of aluminium alloy to the shape of bat by the swaging process. However, even if a metal pipe having an excellent property as to its hardness, tension or the like is employed to enhance the performance of the bat formed, the conventional swaging process in which the formation of the bat is attained by moving the upper and lower dies in the upper and the lower directions in a high speed has deteriorated the alloy structure of the metal pipe, causing the metal bat thus formed to be cracked or broken during the use thereof in baseball play. Further, although it is desired that the baseball bat made of metal pipe is formed to have a thick wall at its larger diameter at which a ball is to be hit and a thin wall at its smaller diameter or grip portion, the swaging process has been liable to make the larger diameter portion thin and the grip portion thick and this can be said to be a drawback inherent to the swaging process. Furthermore, the metal baseball bat formed by the conventional process has its grip end formed by welding a different grip end to the grip portion of the bat, thus causing the welded grip end to come off in baseball play, which was very dangerous to the players.

SUMMARY OF THE INVENTION

The present invention is intended to eliminate the above-mentioned drawbacks.

Accordingly, a primary object of the present invention is to provide a process for forming metal pipes to a desired shape comprising fitting a metal pipe onto a model having same profile as the one desired to form, fixing the metal pipe thereon, arranging a plurality of metal rollers at same distance and around the metal pipe in such a manner that these rollers are in contact with the pipe always keeping their centers on the circumference of a concentric circle irrespective of the change in their position during their forward and backward movement relative to the longitudinal center axis of the model and rotating the metal pipe integral with the model in the longitudinal direction while forcing the rollers to move forwards and backwards.

Another object of the present invention is to provide a process for forming metal pipes to have any shapes or any wall thicknesses desired without deteriorating the property and the strength of the metal pipes.

Further object of the present invention is to provide a process for forming metal pipes to a desired shape capable of avoiding the deterioration of the metal pipes which has been inherent to the conventional swaging process.

Still further object of the present invention is to provide a process enabling a delicate work to be attained in the course of processing a long sized metal pipe because the pipe can be securedly held.

Still further object of the present invention is to provide a process capable of attaining an extremely noiseless work in the course of processing.

Still further object of the present invention is to provide a process capable of gaining a baseball bat of metal pipe suitable for use in baseball game.

Still further object of the present invention is to provide a process capable of effectively manufacturing products of metal pipes used as furniture, structural materials and athletic tools such as ski stocks, golf shafts or the like.

These and other objects as well as merits of the present invention will be apparent from the following detailed description with reference to the accompanying drawings.

DETAILED DESCRIPTION OF THE PREFERRED EMBODIMENTS

There will be now described an embodiment of the present invention in which an aluminium pipe is formed to a baseball bat which is recently gaining an increase in demand.

Figure 1:
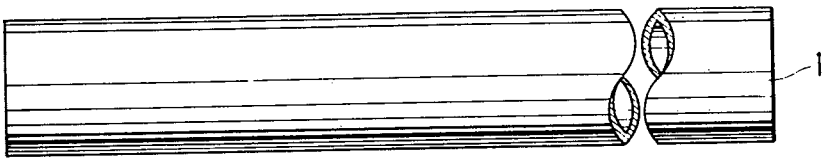
FIG. 1 is a plane view of a metal pipe used in the present invention.
Figure 2:
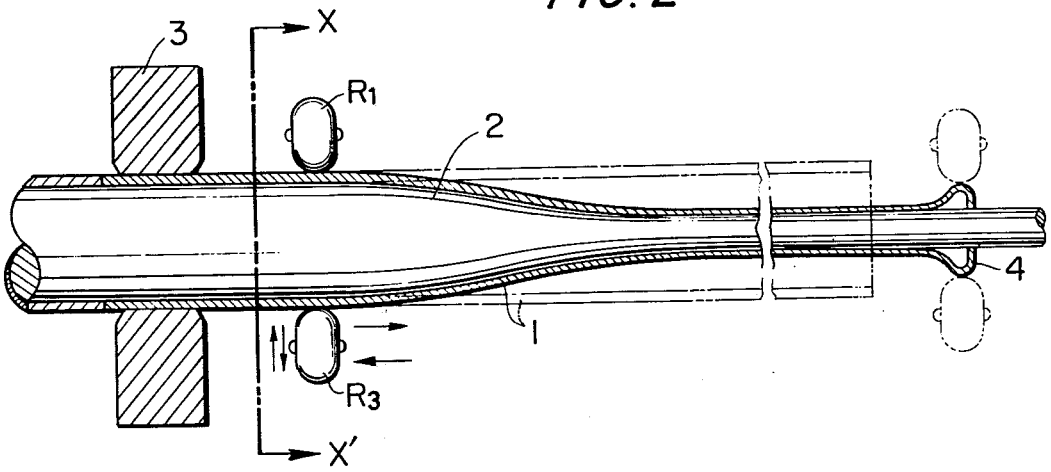
FIG. 2 is a view showing how a metal baseball bat is formed.
Figure 3:
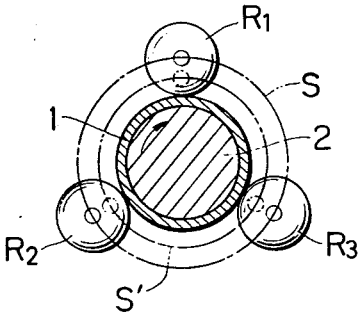
FIG. 3 is a view showing the arrangement of metal rollers and viewed from the line X — X' in FIG. 2.
Figure 4:
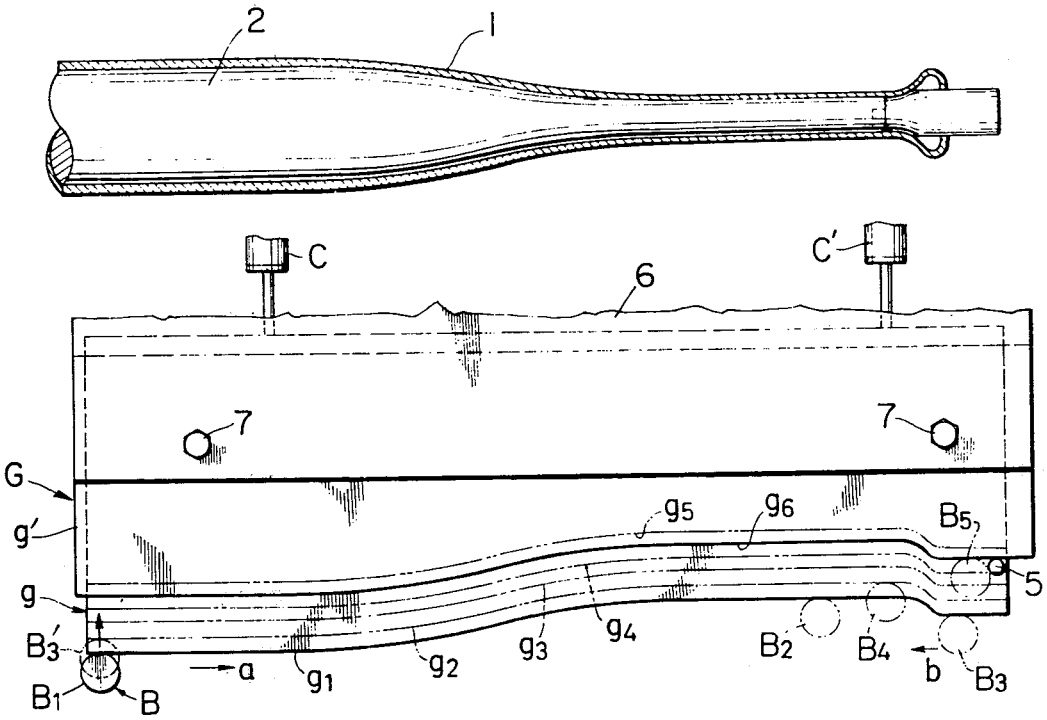
FIG. 4 is a plane view showing the relation between a copying device and the metal pipe to be formed.
Figure 5:
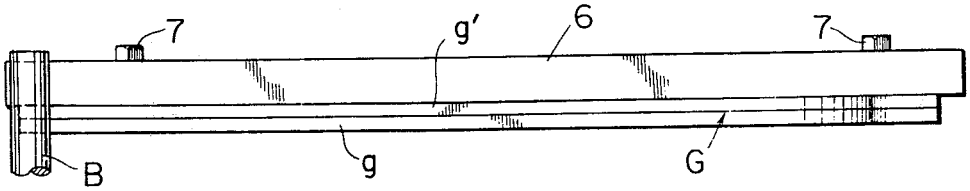
FIG. 5 is a front view showing the copying device shown in FIG. 4.
Figure 6:
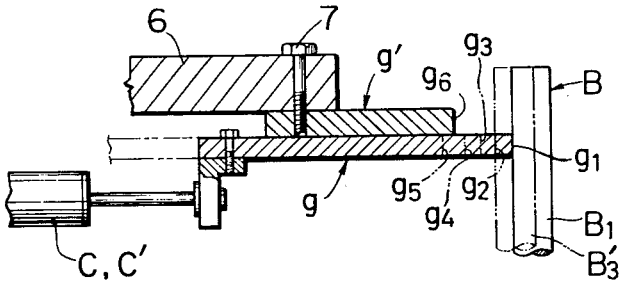
FIG. 6 is a side view of the copying device shown in FIG. 4.

An aluminium pipe 1 shown in FIG. 1 and having a thickness of about two mm is fitted onto a model 2 having a profile of baseball bat and grasped by a chuck 3 as shown in FIG. 2. These aluminium pipe 1, model 2 and chuck are arranged to rotate as one body. Around the aluminium pipe 1 are arranged a plurality (three to about six) of metal rollers $R_1$, $R_2$ and $R_3$ in such a manner that these metal rollers are in contact with the aluminium pipe 1 and that the centers of these metal rollers are always kept on the circumference of a circle concentric to a circle (S) irrespective of their forward and backward movement relative to the longitudinal center axis of the model 2, said circle (S) being formed by combining the centers of the metal rollers with one another (see FIG. 3). In FIG. 3 symbol (S') represents a circle concentric to the circle (S). These metal rollers $R_1$,$R_2$ and $R_3$ move, rotating from the foremost end of the larger diameter portion of the aluminium pipe 1 to the grip end thereof (as shown FIG. 2). The movement of the metal rollers $R_1$, $R_2$ and $R_3$ is attained as follows:

The movement of a guiding bar (B), which functions as the circular stylus, moving along the edge of a variable gauge (*g*) of a gauge (G) is transmitted through a servo mechanism to a first cylinder which is arranged in contact with and serves to drive the roller $R_1$, said variable gauge (*g*) being moved to change its edge as an edge $g_1$, $g_2$, $g_3$ ------ progressively, and said gauge (G) being arranged opposite the model 2, consisting of the variable gauge (*g*) and a fixed gauge (*g'*) and functioning as a copying device as shown in FIG. 4; the movement of the first cylinder is detected by a command potentiometer attached to the first cylinder; the movement detected is transmitted to respective potentiometers attached to the rollers $R_2$ and $R_3$ to thereby render a second cylinder operative, which serves to drive the roller $R_2$, and a third cylinder also operative, which serves to drive the roller $R_3$; and, thus, the rollers $R_2$ and $R_3$ are driven synchronously with the movement of the roller $R_1$.

Accordingly, moving forwards and backwards relative to the longitudinal center axis of the model 2, each roller also moves to transmit to the surface of the aluminium pipe 1 same profile as that of the edge of the variable gauge (*g*). The movement of the guiding bar (B) which moves in the direction as shown by an arrow (*a*) in FIG. 4 from its starting point ($B_1$) along the curved edge $g_1$ of the variable guage (*g*) to a point ($B_2$) is transmitted at the same time to each of the rollers as described above, thus enabling the rollers to form the surface of the aluminium pipe 1 to the same profile as that of the edge $g_1$ of the variable gauge (*g*).

When the guiding bar (B) passing through the point ($B_2$) reaches another point ($B_3$) at which the guiding bar (B) is to be turned, the guiding bar (B) is brought into contact with a microswitch or a limit switch (not shown) located at this point ($B_3$) and turned to reversely move in the direction as shown by an arrow (*b*) in FIG. 4. The guiding bar (B) may be arranged to move in the right and the left directions by a mechanism comprising a rack and a pinion or may be attached to a member such as a lead screw and reversed by a reversible motor. Or the guiding bar (B) may be moved in the right and the left directions by an oil cylinder. Or, for the purpose of always keeping the guiding bar (B) contacted with the edge of the variable gauge (*g*), a spring may be arranged between the guiding bar (B) and the oil cylinder, which serves to urge the guiding bar (B) to the edge of the variable gauge (*g*), so as to elastically urge the guiding bar (B) to the edge of the variable gauge (*g*) according to its positional change. Or the guiding bar (B) may be arranged to contact with the edge of the variable gauge (*g*) by a magnetic switch.

As the process progresses, the variable gauge (*g*) is guided underneath the fixed gauge (*g'*) to progressively occupy the position $g_2$ and the guiding bar (B) is moving back to a point ($B'_3$) while continuing the formation of the aluminium pipe 1. Now, the guiding bar (B) moves along the edge $g_2$ of the variable gauge (*g*). Symbol ($B_4$) represents a position at which the guiding bar (B) is located in the course of a second stage of the process. The guiding bar (B) follows the edge of the variable gauge (*g*) which is guided underneath the fixed guage (*g'*) to approach the edge of this fixed gauge (*g'*) while progressively occupying positions $g_3$, $g_4$ ------, respectively, and the movement of the guiding bar (B) is transmitted to the rollers $R_1$, $R_2$ and $R_3$ to progress the process (a multicycle operation). Transmission of movement is attained through an oil mechanism and an electrical mechanism.

Finally, the variable gauge (*g*) is retreated underneath the fixed gauge (*g'*) to locate its edge at a position $g_5$ and the guiding bar (B) moves along the edge $g_6$ of the fixed gauge (') to perform a final stage of the precess. And when the guiding bar (B) reaches a position ($B_5$), all stages of the process are finished. In FIG. 4 numeral 5 denotes a stopper, symbols (C) and (C') oil cylinders which serve to draw the variable gauge (*g*), numeral 6 a plate for fixing the fixed gauge (*g'*) and 7 bolts for attaching the fixed gauge (*g'*) to the plate 6.

As described above, the rollers $R_1$, $R_2$ and $R_3$ move in the right and the left directions from the position shown in FIG. 2 to the grip end while pressing the aluminium pipe 1 to the model 2, thus forming the aluminium pipe 1 to closely fit the outer circumference of the model 2.

According to the present invention the formation of the grip portion is attained not by the violent impacts of the upper and the lower dies which have been common in the swaging process, but by the contact pressure of the rollers, so that the aluminium pipe 1 can be formed without losing its property and without noise. The formation of uniform wall thickness and the adjustment of the wall thickness of the aluminium pipe 1 are attained by the adjustment of movement of each of the rollers and the variable gauge. The multicycle operation of the gauge (G) allows the rollers $R_1$, $R_2$ and $R_3$ to freely move in the right and the left directions as well as in the forward and the backward directions relative to the longitudinal center axis of the model 2, so that the formation of the complicatedly curved grip portion can be easily attained, for example, by progressively retreating the rollers $R_1$, $R_2$ and $R_3$ as they are approaching the end of the grip portion. According to the present invention the grip end 4 can be formed as shown in FIG. 2 by tolerably retreating and forwarding the rollers $R_1$, $R_2$ and $R_3$ relative to the longitudinal center axis of the model 2 at the position corresponding to the grip end 4.

A long sized material could not be formed by the conventional process using a piece of roller, because it was extremely bent or vibrated when pressed by the roller. Different from this conventional process, the process according to the present invention in which a plurality of rollers are employed provides such an advantage that the respective rollers serve to form a material, particularly long sized, holding it securedly, thus enabling it to be uniformly formed in a substantially shorter time period.

Figure 7:
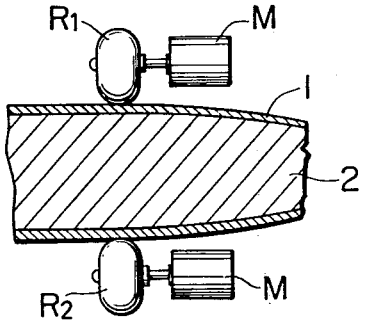
FIG. 7 is a view showing the metal rollers provided with motors.

Further, when each of the rollers is provided with a dwarf motor (M) as shown in FIG. 7 so as to be forcedly driven, the long sized material can be formed without twisting.

Figure 8:
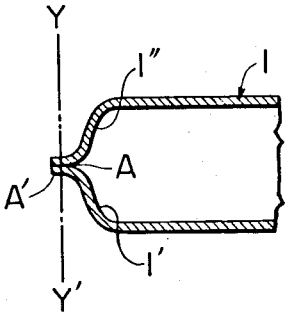
FIG. 8 is a view showing how the end of the metal baseball bat is processed.
Figure 9:
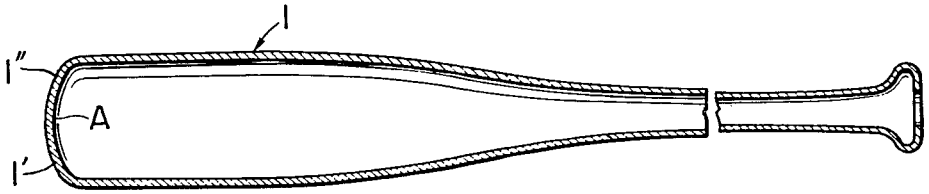
FIG. 9 is a view showing the finished end of the metal baseball bat shown in FIG. 8.

The end of the larger diameter portion of the almost finished aluminium pipe 1 is ready for a further formation by detaching the pipe from the model 2 and then letting it be again greasped by the chuck 3. Namely, the formation of this end is also carried out by the copying operation of the gauge (G) (a combination of the fixed and the variable gauges). In FIG. 8 the end portions 1' and 1'' of the almost finished aluminium pipe 1 are bent inwardly by the rollers to contact at a center (A) with each other and then more strongly pressed to form a projection (A'). And when this projection (A') is cut off along the line Y — Y', the end portions 1' and 1'' of the almost finished aluminium pipe 1 become integral with each other to completely close an opening at the end portions without any traces of the opening.

The formation of bending the grip end inwardly can be attained by the same process as at the end of the larger diameter portion of the almost finished aluminium pipe 1.

The process according to the present invention can be applied to the formation of metal ski stocks, metal golf shafts and structural pipe materials such as legs for a desk or a table, railings, handrails or the like.

It may be understood that any variations and modifications of the process are included in the scope and spirit of the claims and specification of the present invention.

What is claimed is:

1. A process for forming metal pipes to a desired shape comprising fitting a metal pipe onto a model having same profile as the one desired to form, fixing the pipe on the model, arranging a plurality of metal rollers at the same distance and around the metal pipe in such a manner that these rollers are in contact with the pipe always keeping their centers on the circumference of a concentric circle and on a plane perpendicular to the longitudinal center axis of the model irrespective of the change in their position during their forward and backward movement relative to and their left or rightward movement along the longtudinal center axis of the model, each of said metal rollers being provided with a driving means so that each of said rollers may be forcibly driven, and rotating the metal pipe integral with the model in the longitudinal direction while forcing the rollers to move relative to and along the longitudinal center axis of the model to thereby form the metal pipe to a desired shape.

* * * * *